US012179063B2

(12) United States Patent
Belson et al.

(10) Patent No.: US 12,179,063 B2
(45) Date of Patent: Dec. 31, 2024

(54) PROGRESSIVE STRENGTH BASELINE

(71) Applicant: Tonal Systems, Inc., San Francisco, CA (US)

(72) Inventors: Brandt Belson, San Francisco, CA (US); Aly E. Orady, San Francisco, CA (US)

(73) Assignee: Tonal Systems, Inc., San Francisco, CA (US)

( * ) Notice: Subject to any disclaimer, the term of this patent is extended or adjusted under 35 U.S.C. 154(b) by 115 days.

(21) Appl. No.: 17/356,272

(22) Filed: Jun. 23, 2021

(65) Prior Publication Data

US 2021/0402259 A1 Dec. 30, 2021

Related U.S. Application Data

(60) Provisional application No. 63/045,392, filed on Jun. 29, 2020.

(51) Int. Cl.

| | |
|---|---|
| ***A63B 24/00*** | (2006.01) |
| ***A63B 21/00*** | (2006.01) |
| ***A63B 21/005*** | (2006.01) |

(52) U.S. Cl.

CPC ..... *A63B 24/0087* (2013.01); *A63B 21/0058* (2013.01); *A63B 21/153* (2013.01); *A63B 24/0062* (2013.01); *A63B 2024/0093* (2013.01); *A63B 2220/36* (2013.01)

(58) Field of Classification Search

CPC ..... A63B 24/0087; A63B 24/0062; A63B 2024/0093; A63B 21/0058; A63B 2220/36; A63B 2225/02; A63B 71/0009; A63B 2071/0018; A63B 2071/0027

See application file for complete search history.

(56) References Cited

U.S. PATENT DOCUMENTS

| | | | |
|---|---|---|---|
| 80,289 | A | 7/1868 | Leavitt |
| 4,869,497 | A | 9/1989 | Stewart |
| 4,919,418 | A | 4/1990 | Miller |
| 5,230,672 | A | 7/1993 | Brown |
| 5,254,066 | A | 10/1993 | Brown |
| 5,362,298 | A | 11/1994 | Brown |
| 5,407,402 | A | 4/1995 | Brown |
| 5,919,115 | A | 7/1999 | Horowitz |
| 6,280,361 | B1 | 8/2001 | Harvey |
| 6,837,830 | B2 | 1/2005 | Eldridge |
| 7,967,728 | B2 | 6/2011 | Zavadsky |
| 8,287,434 | B2 | 10/2012 | Zavadsky |
| 8,900,099 | B1 | 12/2014 | Boyette |
| 9,731,157 | B2 | 8/2017 | Loach |
| 2004/0087418 | A1 | 5/2004 | Eldridge |
| 2007/0202992 | A1 | 8/2007 | Grasshoff |
| 2010/0069202 | A1 | 3/2010 | Olsen |

(Continued)

FOREIGN PATENT DOCUMENTS

WO 2015139089 9/2015

*Primary Examiner* — Joshua T Kennedy

(74) *Attorney, Agent, or Firm* — Van Pelt, Yi & James LLP

(57) ABSTRACT

Controlling weight during a movement includes receiving a set of parameters comprising a nominal weight. It further includes detecting speed during a concentric phase. It further includes progressively adjusting weight during the concentric phase based on the detected speed and the nominal weight. The weight is progressively adjusted by controlling a resistance mechanism.

13 Claims, 5 Drawing Sheets

(56) References Cited

U.S. PATENT DOCUMENTS

| | | | | |
|---|---|---|---|---|
| 2010/0125026 | A1 | 5/2010 | Zavadsky | |
| 2011/0251021 | A1 | 10/2011 | Zavadsky | |
| 2013/0065680 | A1 | 3/2013 | Zavadsky | |
| 2014/0038777 | A1* | 2/2014 | Bird | A63B 23/03525 482/5 |
| 2014/0113779 | A1 | 4/2014 | Loach | |
| 2015/0066170 | A1 | 3/2015 | Harris | |
| 2016/0158603 | A1 | 6/2016 | Darwood | |
| 2017/0080289 | A1 | 3/2017 | Hashish | |
| 2017/0282015 | A1 | 10/2017 | Wicks | |
| 2018/0001181 | A1 | 1/2018 | Von Prellwitz | |
| 2018/0021616 | A1 | 1/2018 | Orady | |
| 2018/0250553 | A1* | 9/2018 | Pendergast | A63B 24/0003 |
| 2019/0111316 | A1 | 4/2019 | Su | |
| 2019/0134464 | A1* | 5/2019 | Anderton | A61B 5/103 |
| 2019/0344123 | A1* | 11/2019 | Rubin | A63B 24/0062 |
| 2020/0047027 | A1 | 2/2020 | Ward | |
| 2020/0047030 | A1 | 2/2020 | Ward | |
| 2020/0047053 | A1 | 2/2020 | Ward | |
| 2020/0047054 | A1 | 2/2020 | Ward | |
| 2020/0047055 | A1 | 2/2020 | Ward | |
| 2020/0054929 | A1 | 2/2020 | Ward | |

* cited by examiner

PROGRESSIVE STRENGTH BASELINE

CROSS REFERENCE TO OTHER APPLICATIONS

This application claims priority to U.S. Provisional Patent Application No. 63/045,392 entitled PROGRESSIVE STRENGTH BASELINE filed Jun. 29, 2020 which is incorporated herein by reference for all purposes.

BACKGROUND OF THE INVENTION

Traditional ways to measure a person's strength involve lifting near their one rep maximum ("1RM"), the most weight a person can lift for one exercise repetition, but not two repetitions. This is exhausting to the user, and further risks injury.

BRIEF DESCRIPTION OF THE DRAWINGS

Various embodiments of the invention are disclosed in the following detailed description and the accompanying drawings.

DETAILED DESCRIPTION

Figure 1A:
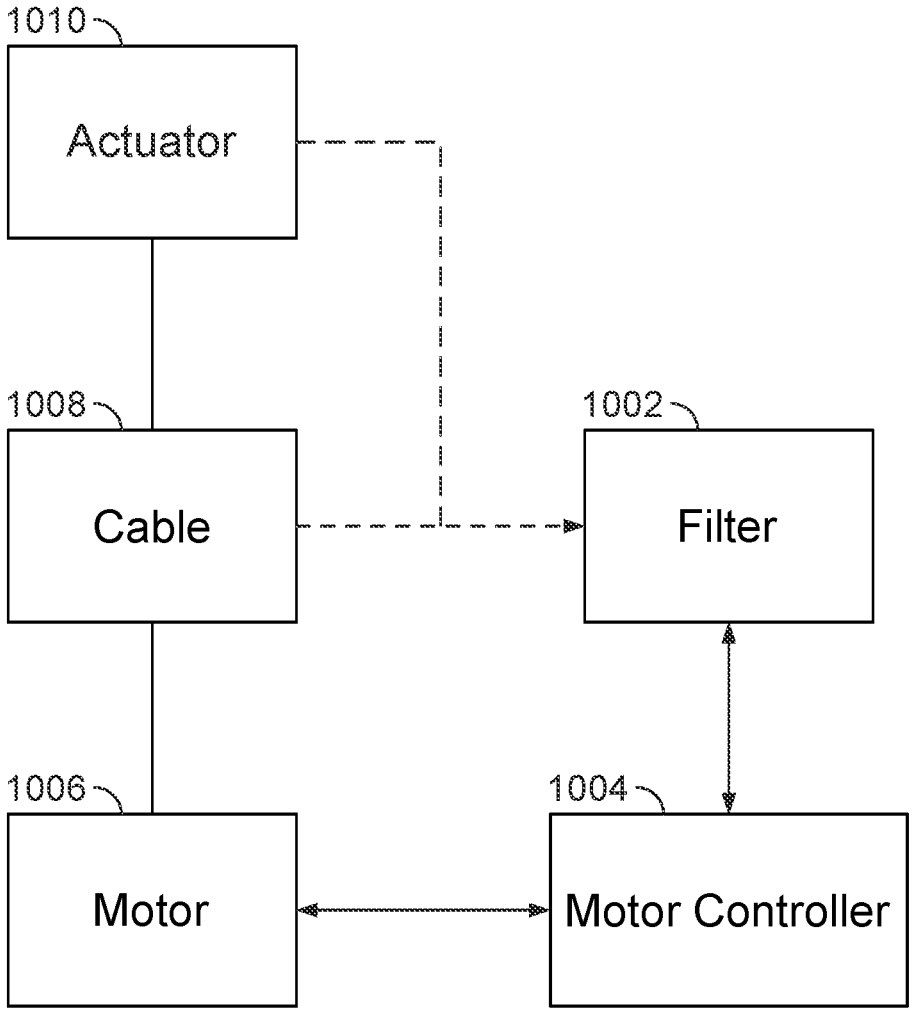
FIG. 1A illustrates an embodiment of an exercise machine.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

Described herein are techniques for estimating the correct resistance to apply to a user on various movements for strength calibration. As will be described in further detail below, the progressive strength calibration techniques described herein quickly hone on the correct weight over a number of repetitions in a calibration set. The progressive calibration mode described herein progressively increases or decreases the applied weight until settling on a weight that is appropriate and challenging for the user for a given move.

Existing techniques for estimating a user's strength include testing for one-rep maxima. Existing one-rep maximum tests include having a user perform exercises with a weight that was reasonably challenging, and having the user perform as many repetitions as possible until failure. Another example of an existing one-rep maximum test is to directly measure the one-rep maximum for a user, which includes adjusting a weight until a user is able to do one repetition, but is unable to do a second repetition. These are injury risks, especially because such one rep-max tests are often performed as part of onboarding, where there is a new user starting with a new trainer, where the new user may not have worked out for months, but is about to perform an exercise repetition at maximum effort.

Other existing techniques for testing a user's strength include isokinetic-based techniques. In existing isokinetic-based techniques, rather than making a one-rep max direct measurement, or bringing a person to failure in terms of repetitions, the user is brought to maximum effort in terms of speed. However, existing isokinetic-based techniques have various issues. For example, existing isokinetic modes often feel unnatural to users, who, because they are uncertain of what to expect, typically do not perform the test with maximum effort. This is a problem because the amount of effort that a person is putting in is difficult to measure.

There are further challenges with existing isokinetic-based strength calibration techniques. For example, existing isokinetic-based strength calibration techniques may be inaccurate. For example, existing isokinetic-based strength calibration techniques use force-velocity curves, which define a relationship between the force and the speed that a user moves at.

However, force-velocity curves are different for different movements. The force-velocity curves are also different for every person. For example, the force-velocity curve for an athlete that performs high-speed motions is different from another athlete such as a power lifter (who lifts a large amount of weight, but is not focused on speed necessarily).

Generating customized force-velocity curves personalized for users and specific to certain movements is time consuming and difficult. For example, generating personalized force-velocity curves for new users is especially difficult, as there is very little data about them. Further, users often do not perform exercises at their maximum effort, and thus estimates of measures such as one-rep max may be low if the exercise is performed incorrectly.

While a generalized force-velocity curve could be used, this results in sources of error, as the use of one size fits all force-velocity curves will result in less accurate estimates of strength.

The progressive strength calibration techniques described herein address the aforementioned issues with existing strength calibration techniques. The progressive strength calibration techniques described herein facilitate (re)calibration of a user for any move. The progressive strength calibration described herein may be applied to any move at any time in order to determine an estimate of strength. This is beneficial, as there may be a variety of reasons that a user's strength has changed, such as due to injury, having been away from exercising for some time, etc.

Further, the progressive calibration techniques described herein may be used to estimate a user's strength without requiring the user to perform a movement to failure, thereby reducing the risk of injury, as compared to existing strength calibration techniques. In addition to reducing the injury risk compared to existing strength calibration techniques, the progressive strength calibration described herein has the following benefits:

Works well with any clothing

Works well if the user is not warmed up

The movement is easy for the user to perform

The user is not pushed to failure

The calibration mode described herein has the feel of a typical weight that would be applied to the user.

Further, as will be described in further detail below, the progressive strength calibration described herein may be performed inline as part of a workout routine, for example, by swapping out a regular set for a calibration set.

For illustrative purposes, embodiments of progressive strength calibration when using a digital strength training exercise machine are described. The techniques for progressive strength calibration described herein may be variously adapted to accommodate any other type of exercise machine, such as other cable resistance exercise machines, as appropriate.

Example Digital Strength Trainer

FIG. 1A illustrates an embodiment of an exercise machine. In particular, the exercise machine of FIG. 1A is an example of a digital strength training machine. In some embodiments, a digital strength trainer uses electricity to generate tension/resistance. Examples of electronic resistance include using an electromagnetic field to generate tension/resistance, using an electronic motor to generate tension/resistance, and using a three-phase brushless direct-current (BLDC) motor to generate tension/resistance. In various embodiments, the form detection and feedback techniques described herein may be variously adapted to accommodate other types of exercise machines using different types of load elements without limitation, such as exercise machines based on pneumatic cylinders, springs, weights, flexing nylon rods, elastics, pneumatics, hydraulics, and/or friction.

Such a digital strength trainer using electricity to generate tension/resistance is also versatile by way of using dynamic resistance, such that tension/resistance may be changed nearly instantaneously. When tension is coupled to position of a user against their range of motion, the digital strength trainer may apply arbitrary applied tension curves, both in terms of position and in terms of phase of the movement: concentric, eccentric, and/or isometric. Furthermore, the shape of these curves may be changed continuously and/or in response to events; the tension may be controlled continuously as a function of a number of internal and external variables including position and phase, and the resulting applied tension curve may be pre-determined and/or adjusted continuously in real time.

The example exercise machine of FIG. 1A includes the following:

a motor controller circuit (1004), which in some embodiments includes a processor, inverter, pulse-width-modulator, and/or a Variable Frequency Drive (VFD);

a motor (1006), for example, a three-phase brushless DC driven by the controller circuit (1004). While a single motor is shown in this example, other numbers of motors may be used. For example, dual motors may be used;

a spool/hub with a cable (1008) wrapped around the spool and coupled to the spool. On the other end of the cable an actuator (1010) is coupled in order for a user to grip and pull on. Examples of actuators include handles and bars that are attached to the cables. The actuators may be attached to the cables at distal ends of the arms of the exercise machine, which are described in further detail below. The spool is coupled to the motor (1006) either directly or via a shaft/belt/chain/gear mechanism;

a filter (1002), to digitally control the controller circuit (1004) based on receiving information from the cable (1008) and/or actuator (1010);

optionally (not shown in FIG. 1A) a gearbox between the motor and spool. Gearboxes multiply torque and/or friction, divide speed, and/or split power to multiple spools. A number of combinations of motor and gearbox may also be used. A cable-pulley system may be used in place of a gearbox, and/or a dual motor may be used in place of a gearbox;

one or more of the following sensors (not shown in FIG. 1A):

encoders: In various embodiments, encoders are used to measure cable lengths (e.g., left and right cable lengths in this example), cable speeds, weight (tension), etc.

One example of an encoder is a position encoder; a sensor to measure position of the actuator (1010) or motor (1006). Examples of position encoders include a hall effect shaft encoder, grey-code encoder on the motor/spool/cable (1008), an accelerometer in the actuator/handle (1010), optical sensors, position measurement sensors/methods built directly into the motor (1006), and/or optical encoders. In one embodiment, an optical encoder is used with an encoding pattern that uses phase to determine direction associated with the low resolution encoder. As another example, a magnetic encoder is used to determine cable position/length. Other mechanisms that measure back-EMF (back electromagnetic force) from the motor (1006) in order to calculate position may also be used;

a motor power sensor; a sensor to measure voltage and/or current being consumed by the motor (1006);

a user tension sensor; a torque/tension/strain sensor and/or gauge to measure how much tension/force is being applied to the actuator (1010) by the user. In one embodiment, a tension sensor is built into the cable (1008). Alternatively, a strain gauge is built into the motor mount holding the motor (1006). As the user pulls on the actuator (1010), this translates into strain on the motor mount which is measured using a strain gauge in a Wheatstone bridge configuration. In another embodiment, the cable (1008) is guided through a pulley coupled to a load cell. In another embodiment, a belt coupling the motor (1006) and cable spool or gearbox (1008) is guided through a pulley coupled to a load cell. In another embodiment, the resistance generated by the motor (1006) is characterized based on the voltage, current, or frequency input to the motor.

Another example of sensors includes inertial measurement units (IMUs). In some embodiments, IMUs are used to measure the acceleration and rate of rotation of actuators. The IMUs may be embedded within or attached to actuators (e.g., in both handles or as an attachment on a bar).

In some embodiments, an IMU is placed on the cable (e.g., via a clip) to determine inertial measurements with respect to the cable. As another example, IMUs may be included in a device that clips onto an actuator accessory such as a bar handle.

Another example type of sensor used by the exercise machine includes cameras.

In some embodiments, the exercise machine includes an embedded camera.

In some embodiments, the exercise machine is communicatively coupled (either in a wired or wireless manner) with a dedicated accessory camera external to the exercise machine that is paired with the exercise machine. The dedicated accessory camera may be set up in a different location to the exercise machine, such as on an adjacent wall, above the exercise machine on the same wall, on a tripod, etc.

In some embodiments, the exercise machine is paired with an external device that has or is attached to a camera, where such devices include mobile phones, tablets, computers, etc.

Various types of cameras may be used. As one example, RGB cameras are used. As another example, cameras with depth-sensing capability are used.

In some embodiments, infrared cameras are used that measure heat, where in some embodiments such information is used to deduce quantities such as muscle exertion, soreness, etc.

In some embodiments, the sensors used by the exercise machine include accessories such as smart watches, with which the exercise machine may be communicatively coupled (e.g., via a wireless connection such as Bluetooth or WiFi). The readings from such sensors may then be used to monitor form.

Other examples of accessories that may be communicatively coupled with the exercise machine include: smart clothing that measures muscle engagement or movement; and smart mats or smart benches that measure spatial distribution of force when the user is on them.

In some embodiments, the exercise machine includes mechanisms to locate devices (e.g., actuators, IMUs, etc.) in 3-Dimensional space. As one example, Bluetooth Low Energy (BLE) spatial locationing (e.g., Angle of Arrival and Angle of Departure "AoA/AoD") is used to locate devices in 3-D space.

In one embodiment, a motor such as, but not limited to, an induction type of brushless motor. In one embodiment, a three-phase brushless DC motor (1006) is used with the following:

- a controller circuit (1004) combined with the filter (1002) that includes:
  - a processor that runs software instructions;
  - three pulse width modulators (PWMs), each with two channels, modulated at 20 kHz;
  - six transistors in an H-Bridge configuration coupled to the three PWMs;
  - optionally, two or three ADCs (Analog to Digital Converters) monitoring current on the H-Bridge; and/or
  - optionally, two or three ADCs monitoring back-EMF voltage;
- the three-phase brushless DC motor (1006), which in some embodiments includes a synchronous-type and/or asynchronous-type permanent magnet motor, such that:
  - the motor (1006) may be in an "out-runner configuration" as described below;
  - the motor (1006) may have a maximum torque output of at least 60 Nm and a maximum speed of at least 300 RPMs;
  - optionally, with an encoder or other method to measure motor position;
- a cable (1008) wrapped around the body of the motor (1006) such that the entire motor (1006) rotates, so the body of the motor is being used as a cable spool in one embodiment. Thus, the motor (1006) is directly coupled to a cable (1008) spool. In one embodiment, the motor (1006) is coupled to a cable spool via a shaft, gearbox, belt, and/or chain, allowing the diameter of the motor (1006) and the diameter of the spool to be independent, as well as introducing a stage to add a set-up or step-down ratio if desired. Alternatively, the motor (1006) is coupled to two spools with an apparatus in between to split or share the power between those two spools. Such an apparatus could include a differential gearbox, or a pulley configuration; In some embodiments, the two motors (dual motor configuration) are each coupled with a respective spool.
- an actuator (1010) such as a handle, a bar, a strap, or other accessory connected directly, indirectly, or via a connector such as a carabiner to the cable (1008).

In some embodiments, the controller circuit (1002, 1004) is programmed to drive the motor in a direction such that it draws the cable (1008) towards the motor (1006). The user pulls on the actuator (1010) coupled to the cable (1008) against the direction of pull of the motor (1006).

One example purpose of this setup is to provide an experience to a user similar to using a traditional cable-based strength training machine, where the cable is attached to a weight stack being acted on by gravity. Rather than the user resisting the pull of gravity, they are instead resisting the pull of the motor (1006).

Note that with a traditional cable-based strength training machine, a weight stack may be moving in two directions: away from the ground or towards the ground. When a user pulls with sufficient tension, the weight stack rises, and as that user reduces tension, gravity overpowers the user and the weight stack returns to the ground.

By contrast in a digital strength trainer, there is no actual weight stack. The notion of the weight stack is one modeled by the system. The physical embodiment is an actuator (1010) coupled to a cable (1008) coupled to a motor (1006). A "weight moving" is instead translated into a motor rotating. As the circumference of the spool is known and how fast it is rotating is known, the linear motion of the cable may be calculated to provide an equivalency to the linear motion of a weight stack. Each rotation of the spool equals a linear motion of one circumference or $2\pi r$ for radius r. Likewise, torque of the motor (1006) may be converted into linear force by multiplying it by radius r.

If the virtual/perceived "weight stack" is moving away from the ground, motor (1006) rotates in one direction. If the "weight stack" is moving towards the ground, motor (1006) rotates in the opposite direction. Note that the motor (1006) is pulling towards the cable (1008) onto the spool. If the cable (1008) is unspooling, it is because a user has overpowered the motor (1006). Thus, note a distinction between the direction the motor (1006) is pulling, and the direction the motor (1006) is actually turning.

If the controller circuit (1002, 1004) is set to drive the motor (1006) with, for example, a constant torque in the direction that spools the cable, corresponding to the same direction as a weight stack being pulled towards the ground, then this translates to a specific force/tension on the cable (1008) and actuator (1010). Referring to this force as "Target Tension," in one embodiment, this force is calculated as a function of torque multiplied by the radius of the spool that the cable (1008) is wrapped around, accounting for any additional stages such as gear boxes or belts that may affect the relationship between cable tension and torque. If a user pulls on the actuator (1010) with more force than the Target Tension, then that user overcomes the motor (1006) and the cable (1008) unspools moving towards that user, being the virtual equivalent of the weight stack rising. However, if that user applies less tension than the Target Tension, then the motor (1006) overcomes the user and the cable (1008) spools onto and moves towards the motor (1006), being the virtual equivalent of the weight stack returning.

Motor. While many motors exist that run in thousands of revolutions per second, an application such as fitness equipment designed for strength training has different requirements and is by comparison a low speed, high torque type application suitable for certain kinds of motors configured for lower speed and higher torque.

In one embodiment, a specification of such a motor (1006) is that a cable (1008) wrapped around a spool of a given diameter, directly coupled to a motor (1006), behaves like a 200 lbs weight stack, with the user pulling the cable at a maximum linear speed of 62 inches per second. The aforementioned weight and linear speed specifications are but examples for illustrative purposes, and the system may be configured to behave to different specifications. A number of motor parameters may be calculated based on the diameter of the spool.

TABLE 1

| User Requirements | | | | | | |
|---|---|---|---|---|---|---|
| Target Weight | 200 lbs | | | | | |
| Target Speed | 62 inches/sec = | | | | 1.5748 meters/sec | |
| **Requirements by Spool Size** | | | | | | |
| Diameter (inches) | 3 | 5 | 6 | 7 | 8 | 9 |
| RPM | 394.7159 | 236.82954 | 197.35795 | 169.1639572 | 148.0184625 | 131.5719667 |
| Torque (Nm) | 67.79 | 112.9833333 | 135.58 | 158.1766667 | 180.7733333 | 203.37 |
| Circumference (inches) | 9.4245 | 15.7075 | 18.849 | 21.9905 | 25.132 | 28.2735 |

Thus, a motor with 67.79 Nm of force and a top speed of 395 RPM, coupled to a spool with a 3 inch diameter meets these requirements.

Hub motors are three-phase permanent magnet BLDC direct drive motors in an "out-runner" configuration: throughout this specification, the "out-runner" configuration refers to the permanent magnets being placed outside the stator rather than inside, as opposed to many motors which have a permanent magnet rotor placed on the inside of the stator as they are designed more for speed than for torque. Out-runners have the magnets on the outside, allowing for a larger magnet and pole count and are designed for torque over speed. Another way to describe an out-runner configuration is when the shaft is fixed and the body of the motor rotates.

Hub motors also tend to be "pancake style." As described herein, pancake motors are higher in diameter and lower in depth than most motors. Pancake style motors are advantageous for a wall mount, subfloor mount, and/or floor mount application where maintaining a low depth is desirable, such as a piece of fitness equipment to be mounted in a consumer's home or in an exercise facility/area. As described herein, a pancake motor is a motor that has a diameter higher than twice its depth. As one example, a pancake motor is between 15 and 60 centimeters in diameter, for example, 22 centimeters in diameter, with a depth between 6 and 15 centimeters, for example, a depth of 6.7 centimeters.

Motors may also be "direct drive," meaning that the motor does not incorporate or require a gear box stage. Many motors are inherently high speed low torque but incorporate an internal gearbox to gear down the motor to a lower speed with higher torque and may be called gear motors. Direct drive motors may be explicitly called as such to indicate that they are not gear motors.

If a motor does not exactly meet the requirements illustrated in the table above, the ratio between speed and torque may be adjusted by using gears or belts to adjust. A motor coupled to a 9" sprocket, coupled via a belt to a spool coupled to a 4.5" sprocket doubles the speed and halves the torque of the motor. Alternately, a 2:1 gear ratio may be used to accomplish the same thing. Likewise, the diameter of the spool may be adjusted to accomplish the same.

Alternately, a motor with 100× the speed and 100th the torque may also be used with a 100:1 gearbox. As such a gearbox also multiplies the friction and/or motor inertia by 100×, torque control schemes become challenging to design for fitness equipment/strength training applications. Friction may then dominate what a user experiences. In other applications friction may be present, but is low enough that it is compensated for, but when it becomes dominant, it is difficult to control for. For these reasons, direct control of motor torque is more appropriate for fitness equipment/strength training systems. This would typically lead to the selection of an induction type motor for which direct control of torque is simple. Although BLDC motors are more directly able to control speed and/or motor position rather than torque, torque control of BLDC motors can be made possible when used in combination with an appropriate encoder.

Figure 1B:
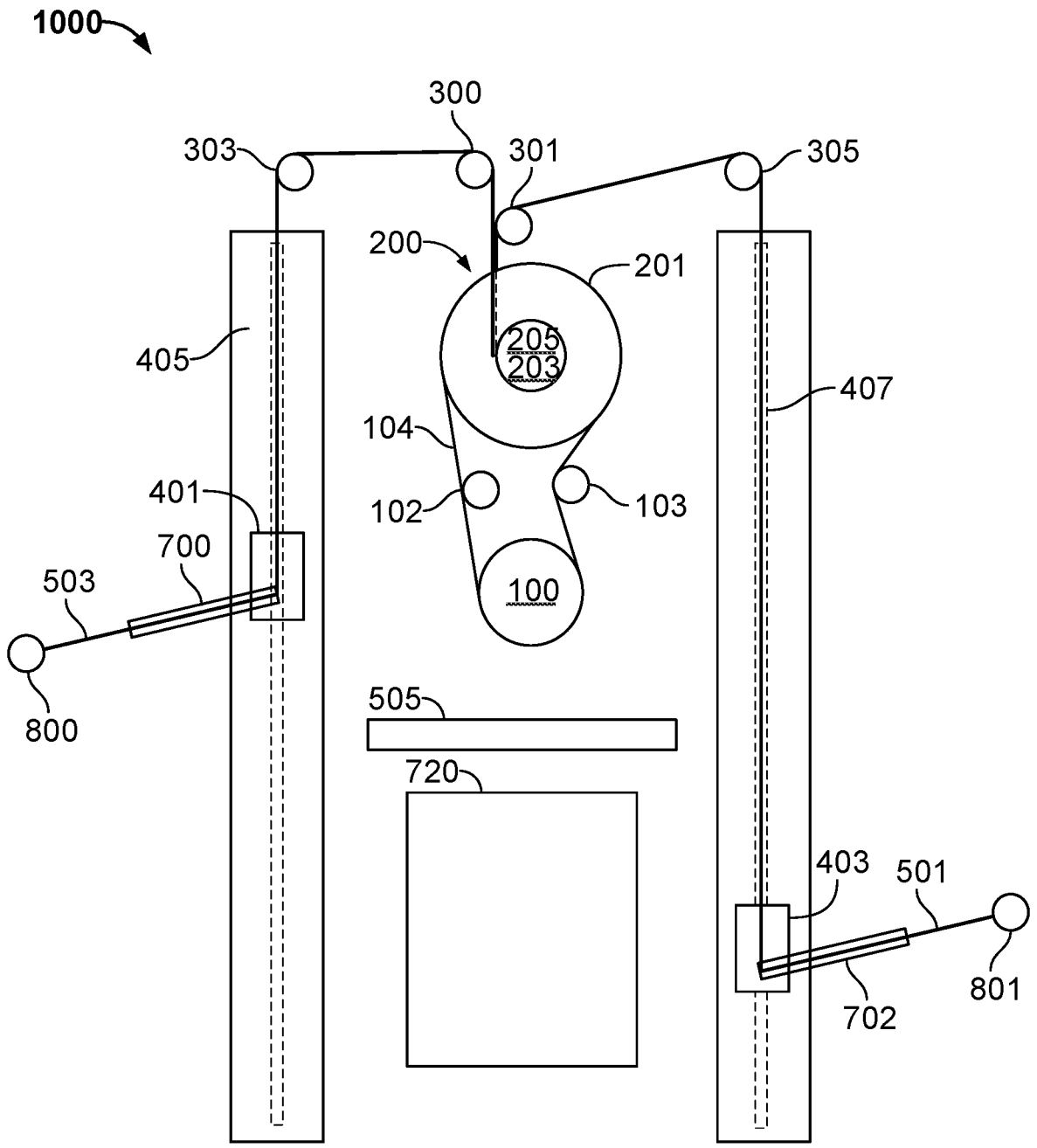
FIG. 1B illustrates a front view of one embodiment of an exercise machine.

FIG. 1B illustrates a front view of one embodiment of an exercise machine. In some embodiments, exercise machine 1000 of FIG. 1B is an example or alternate view of the exercise machine of FIG. 1A. In this example, exercise machine (1000) includes a pancake motor (100), a torque controller coupled to the pancake motor, and a high resolution encoder (102) coupled to the pancake motor (100). As used herein, a "high resolution" encoder refers to an encoder with 30 degrees or greater of electrical angle. In this example, two cables (503) and (501) are coupled respectively to actuators (800) and (801) on one end of the cables. The two cables (503) and (501) are coupled directly or indirectly on the opposite end to the motor (100). While an induction motor may be used for motor (100), a BLDC motor may also be used for its cost, size, weight, and performance. In some embodiments, a high resolution encoder assists the system to determine the position of the BLDC motor to control torque. While an example involving a single motor is shown, the exercise machine may include other configurations of motors, such as dual motors, with each cable coupled to a respective motor.

Sliders (401) and (403) may be respectively used to guide the cable (503) and (501) respectively along rails (405) and (407). The exercise machine in FIG. 1B translates motor torque into cable tension. As a user pulls on actuators (800) and/or (801), the machine creates/maintains tension on cable (503) and/or (501). The actuators (800, 801) and/or cables (503, 501) may be actuated in tandem or independently of one another.

In one embodiment, electronics bay (720) is included and has the necessary electronics to drive the system. In one embodiment, fan tray (505) is included and has fans that cool the electronics bay (720) and/or motor (100).

Motor (100) is coupled by belt (104) to an encoder (102), an optional belt tensioner (103), and a spool assembly (200). In one embodiment, motor (100) is an out-runner, such that the shaft is fixed and the motor body rotates around that shaft. In one embodiment, motor (100) generates torque in the counter-clockwise direction facing the machine, as in the example in FIG. 1B. Motor (100) has teeth compatible with the belt integrated into the body of the motor along the outer circumference. Referencing an orientation viewing the front of the system, the left side of the belt (104) is under tension, while the right side of the belt is slack. The belt tensioner (103) takes up any slack in the belt. An optical rotary encoder (102) coupled to the tensioned side of the belt (104) captures all motor movement, with significant accuracy because of the belt tension. In one embodiment, the optical rotary encoder (102) is a high resolution encoder. In one embodiment, a toothed belt (104) is used to reduce belt slip. The spools rotate counter-clockwise as they are spooling cable/taking cable in, and clockwise as they are unspooling/releasing cable out.

Spool assembly (200) comprises a front spool (203), rear spool (205), and belt sprocket (201). The spool assembly (200) couples the belt (104) to the belt sprocket (201), and couples the two cables (503) and (501) respectively with spools (205) and (203). Each of these components is part of a low profile design. In one embodiment, a dual motor configuration not shown in FIG. 1B is used to drive each cable (503) and (501). In the example shown in FIG. 1B, a single motor (100) is used as a single source of tension, with a plurality of gears configured as a differential are used to allow the two cables/actuators to be operated independently or in tandem. In one embodiment, spools (205) and (203) are directly adjacent to sprocket (201), thereby minimizing the profile of the machine in FIG. 1B.

As shown in FIG. 1B, two arms (700, 702), two cables (503, 501) and two spools (205, 203) are useful for users with two hands, and the principles disclosed without limitation may be extended to three, four, or more arms (700) for quadrupeds and/or group exercise. In one embodiment, the plurality of cables (503, 501) and spools (205, 203) are driven by one sprocket (201), one belt (104), and one motor (100), and so the machine (1000) combines the pairs of devices associated with each user hand into a single device. In other embodiments, each arm is associated with its own motor and spool.

In one embodiment, motor (100) provides constant tension on cables (503) and (501) despite the fact that each of cables (503) and (501) may move at different speeds. For example, some physical exercises may require use of only one cable at a time. For another example, a user may be stronger on one side of their body than another side, causing differential speed of movement between cables (503) and (501). In one embodiment, a device combining dual cables (503) and (501) for a single belt (104) and sprocket (201) retains a low profile, in order to maintain the compact nature of the machine, which can be mounted on a wall.

In one embodiment, pancake style motor(s) (100), sprocket(s) (201), and spools (205, 203) are manufactured and arranged in such a way that they physically fit together within the same space, thereby maximizing functionality while maintaining a low profile.

As shown in FIG. 1B, spools (205) and (203) are respectively coupled to cables (503) and (501) that are wrapped around the spools. The cables (503) and (501) route through the system to actuators (800) and (801), respectively.

The cables (503) and (501) are respectively positioned in part by the use of "arms" (700) and (702). The arms (700) and (702) provide a framework for which pulleys and/or pivot points may be positioned. The base of arm (700) is at arm slider (401) and the base of arm (702) is at arm slider (403).

The cable (503) for a left arm (700) is attached at one end to actuator (800). The cable routes via arm slider (401) where it engages a pulley as it changes direction, then routes along the axis of rotation of track (405). At the top of rail/track (405), fixed to the frame rather than the track, is pulley (303) that orients the cable in the direction of pulley (300), that further orients the cable (503) in the direction of spool (205), wherein the cable (503) is wound around spool (205) and attached to spool (205) at the other end.

Similarly, the cable (501) for a right arm (702) is attached at one end to actuator (801). The cable (501) routes via slider (403) where it engages a pulley as it changes direction, then routes along the axis of rotation of rail/track (407). At the top of the rail/track (407), fixed to the frame rather than the track is pulley (305) that orients the cable in the direction of pulley (301), that further orients the cable in the direction of spool (203), wherein the cable (501) is wound around spool (203) and attached to spool (203) at the other end.

One use of pulleys (300, 301) is that they permit the respective cables (503, 501) to engage respective spools (205, 203) "straight on" rather than at an angle, wherein "straight on" references being within the plane perpendicular to the axis of rotation of the given spool. If the given cable were engaged at an angle, that cable may bunch up on one side of the given spool rather than being distributed evenly along the given spool.

In the example shown in FIG. 1B, pulley (301) is lower than pulley (300). This demonstrates the flexibility of routing cables. In one embodiment, mounting pulley (301) leaves clearance for certain design aesthetic elements that make the machine appear to be thinner.

In one embodiment, the exercise machine/appliance passes a load/resistance against the user via one or more lines/cables, to a grip(s) (examples of an actuator) that a user displaces to exercise. A grip may be positioned relative to the user using a load arm and the load path to the user may be steered using pulleys at the load arm ends, as described above. The load arm may be connected to a frame of the exercise machine using a carriage that moves within a track that may be affixed to the main part of the frame. In one embodiment, the frame is firmly attached to a rigid structure such as a wall. In some embodiments, the frame is not mounted directly to the wall. Instead, a wall bracket is first mounted to the wall, and the frame is attached to the wall bracket. In other embodiments, the exercise machine is mounted to the floor. The exercise machine may be mounted to both the floor and the wall for increased stability. In other embodiments, the exercise machine is a freestanding device.

In some embodiments, the exercise machine includes a media controller and/or processor, which monitors/measures user performance (for example, using the one or more sensors described above), and determines loads to be applied to the user's efforts in the resistance unit (e.g., motor described above). Without limitation, the media controller and processor may be separate control units or combined in a single package. In some embodiments, the controller is further coupled to a display/acoustic channel that allows instructional information to be presented to a user and with which the user interacts in a visual manner, which includes communication based on the eye such as video and/or text or icons, and/or an auditory manner, which includes communication based on the ear such as verbal speech, text-to-speech synthesis, and/or music. Collocated with an information channel is a data channel that passes control program information to the processor which generates, for example, exercise loading schedules. In some embodiments, the display is embedded or incorporated into the exercise machine, but need not be (e.g., the display or screen may be separate from the exercise machine, and may be part of a separate device such as a smartphone, tablet, laptop, etc. that may be communicatively coupled (e.g., either in a wired or wireless manner) to the exercise machine). In one embodiment, the display is a large format, surround screen representing a virtual reality/alternate reality environment to the user; a virtual reality and/or alternate reality presentation may also be made using a headset. The display may be oriented in landscape or portrait.

In one embodiment, the appliance media controller provides audio information that is related to the visual information from a program store/repository that may be coupled to external devices or transducers to provide the user with an auditory experience that matches the visual experience. Control instructions that set the operational parameters of the resistance unit for controlling the load or resistance for the user may be embedded with the user information so that the media package includes information usable by the controller to run the machine. In this way a user may choose an exercise regime and may be provided with cues, visual and auditory as appropriate, that allow, for example, the actions of a personal trainer to be emulated. The controller may further emulate the actions of a trainer using an expert system and thus exhibit artificial intelligence. The user may better form a relationship with the emulated coach or trainer, and this relationship may be encouraged by using emotional/mood cues whose effect may be quantified based on performance metrics gleaned from exercise records that track user performance in a feedback loop using, for example, the sensor(s) described above.

Figure 2:
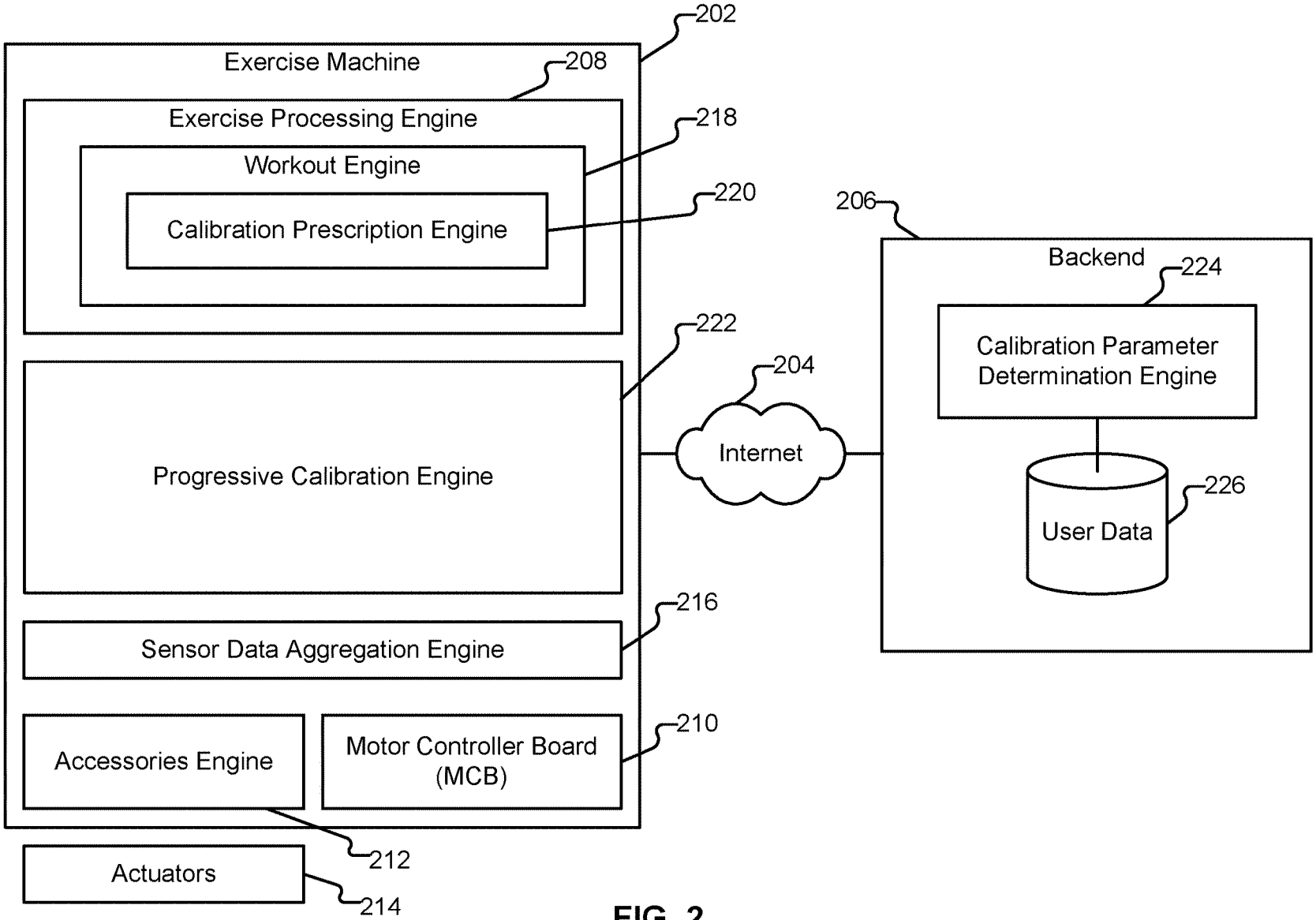
FIG. 2 illustrates an embodiment of a system for progressive strength calibration.

FIG. 2 illustrates an embodiment of a system for progressive strength calibration. In this example, exercise machine 202 is an alternate view of the exercise machine embodiments shown in FIGS. 1A and 1B. As shown in this example, exercise machine 202 also communicates (over a network 204 such as the Internet) with backend 206.

In this example, exercise machine 202 includes exercise processing engine 208, motor controller board 210 (an example of motor controller 1004), accessories engine 212, and actuators 214. In some embodiments, these elements are compute/sensor nodes that form a computation architecture/stack in which sensor measurements are taken, and computations on such sensor measurements are made, at various levels.

In this example, at the bottom level/layer of the stack are actuators/accessories 214, examples of which include handles, bar controllers, smart mats, etc. In some embodiments, the sensors at the level of actuators 214 include IMUs, buttons, force sensors, etc.

At the next level of the computation architecture is accessories engine 212. Accessories engine 212 is configured to aggregate sensor data from the actuators. As one example, accessories engine 212 is implemented using the BLE (Bluetooth Low Energy) Central plugin, which communicates with accessories (e.g., via BLE, USB, RF, etc.). In some embodiments, the accessories engine is configured to determine the positions of accessories/actuators in physical space.

At the next level of the computation stack is motor controller board (MCB) 210. MCB 210 is another example of a computation node/layer in the computation architecture. In this example, the motor controller board collects data such as cable position and speed, motor position and speed, cable tension, scalable stack information (e.g., health of the motor, board, processor/memory of the board, and communication), etc. As one example, the motor controller board (MCB) is configured to receive encoder messages and determine right and left cable lengths. In some embodiments, the MCB provides such sensor readings to sensor data aggregation engine 216. The information may be sent via a communication bus such as a USB (Universal Serial Bus). The information may be sent periodically (e.g., at a frequency of 50 Hz).

In the next layer of the computation architecture is exercise processing engine 208. In some embodiments, exercise processing engine 208 is a portion of an application running on a computing device included or otherwise associated with the exercise machine. As one example, the application is an Android application running on a computing device such as an Android tablet or computing device embedded in the exercise machine.

In this example, exercise processing engine 208 includes workout engine 218. In some embodiments, the cloud entity (backend 206) includes a system for creating workouts. This includes stitching together clips of video and audio in an automated manner. The outline or plan for the workout is referred to herein as a "timeline," which indicates what events (e.g., exercise movements, transitions between movements, audiovisual cues, etc.) should happen at what times. In some embodiments, flexibility is built in depending on the user's actions. In some embodiments, workouts generated by the backend are downloaded by the client exercise machine (exercise machine 202), where workout engine 218 is configured to play the workout according to the timeline. In other embodiments, workout engine 218 is configured to generate timelines.

In this example, workout engine 218 further includes calibration prescription engine 220. Calibration prescription engine 220 is configured to determine whether to prescribe calibration for a movement (e.g., in the timeline). Examples of conditions for determining whether to prescribe calibration include inactivity, injury, etc., as will be described in further detail herein. If the calibration prescription engine determines that calibration should be prescribed for a given movement, the workout engine, for example, modifies the timeline to indicate that, for a given set of the movement, progressive calibration mode is turned on (e.g., via a flag). This indicates to progressive calibration engine 222 that progressive calibration is to be performed for the set. As will be described in further detail below, the progressive calibration engine is configured to, during the calibration set, control the motor such that the weight applied to the user is progressively adjusted. In some embodiments, calibration parameters (e.g., movement parameters and calibration algorithm parameters) are passed to progressive calibration engine 222. Further details regarding calibration parameters will be described below. In some embodiments, the calibration parameters are received from backend 206. In this example, the calibration parameters are determined by calibration parameter determination engine 224. In some embodiments, the calibration parameters are determined using global user data (e.g., user data stored in user data store 226). Further details regarding selection or determination of calibration parameters will be described below.

Progressive calibration engine 222 is configured to execute progressive strength calibration. In some embodiments, this includes controlling the motor (e.g., using firmware to control MCB 210) to implement progressive strength calibration. The progressive strength calibration is performed using calibration parameters. Further details regarding progressive strength calibration are described below. As will be described in further detail below, the progressive strength calibration is performed in part by processing and analyzing sensor data (e.g., from accessories and the MCB), as well as user data stored in user data store 226 (e.g., user profile, measurements, goals, suggested weights, etc.), workout data (e.g., current move, load profile for the current move, etc.), camera and microphone information, etc.

The next layer of the computation architecture includes backend 206. In this example, the backend compute node includes calibration parameter determination engine 224 and user data store 226. User data store 226 includes information aggregated from multiple users of multiple exercise machines, and includes, for example, population statistics for all or subsets of users. The user data store also includes data specific to individual users. As will be described in further detail below, the data in user data store 226 is used to determine personalized calibration parameters. In one embodiment, backend 206 is implemented on Amazon EC2 instances.

As shown in this example, data and data streams, such as sensors and user information/preferences, are distributed throughout the system/computation architecture.

In some embodiments, progressive strength calibration is performed based on data collected from multiple sensors. Data may be fused, correlated, or analyzed at any compute node in a process referred to herein as "sensor fusion." The sensor data may also be passed through or pushed downwards to be operated on by various compute nodes in the computation stack.

As one example, suppose that the actuators 214 being used are two handles. The measurements taken from sensors (e.g., IMUs) in the two handles are passed to accessories engine 212 of the exercise machine, which aggregates, for example, sensor readings from all actuators. The actuator sensor data is then passed to exercise processing engine 208.

Sensor information collected by MCB 210 is also passed to sensor data aggregation engine 216. As shown in this example, sensor data aggregation engine 216 is configured to collect and aggregate the various and disparate sensor information (e.g., IMU sensor data, cable/motor/tension sensor data, etc.). Progressive calibration engine 222 is then configured to perform progressive strength calibration using the combined sensor data.

In some embodiments, data, such as workout data (e.g., from MCB 210) and accessory data (e.g., smart bench data), is provided to backend 206.

In various embodiments, progressive strength calibration is calculated at any of the above compute nodes in the computation architecture. In some embodiments, the algorithms and logic to perform the aforementioned progressive strength calibration are distributed across the entire stack with interfaces between each to obtain optimal performance and accuracy, along with low latency. For example, tasks that require latency that is lower than is possible based on communication between layers are done at lower levels. When latency can be higher or when data is taken in aggregate (e.g., across an entire workout), algorithms are run at higher levels where more computational power and contextual data is available.

Further details regarding progressive strength calibration are described below.

Progressive Strength Calibration

Progressive strength calibration engine 222 is configured to determine the right weight for a user over the course of a set of repetitions of a movement (e.g., a weight that is challenging for the user, but will not push the user to failure by the end of a set). As will be described in further detail below, in some embodiments, the progressive strength calibration continuously increases the weight until the user's speed reduces, and then hones in with smaller increases and decreases.

Initialization of Calibration Mode

Determining Whether to Prescribe Calibration Mode

In some embodiments, the calibration mode includes prescribing progressive strength calibration for a set of a movement during a workout routine.

Prescription of the calibration set (e.g., by calibration prescription engine 220) may be triggered based on a variety of conditions. Examples of such conditions include:

- New user
- Time away from the exercise machine: For example, inactivity, where the exercise machine maintains a record of how much time has elapsed since the user has used the exercise machine or otherwise performed exercise. In some embodiments, if the inactive period meets or exceeds a threshold, the progressive calibration mode is triggered or prescribed.
- Change in user's ability: For example, due to injury. As the strength calibration mode described herein progressively increases resistance, rather than providing a test to failure or a direct one-rep maximum test that requires maximum effort from the user, the calibration mode described herein is gentle enough to estimate a user's strength even when they are recovering or returning from injury. Another example of a change in user's ability is post-natal, after giving birth.
- Discrepancies between related movements: In some embodiments, recalibration for movements is performed if it is determined there is a discrepancy (e.g., that exceeds a threshold) in the resistance applied for two related movements.

One example is two related moves—bench press with a bar, and bench press with handles. Suppose that in this example, the normalized (by population average weights, for example) suggested weight for the bench press with the bar is substantially higher (e.g., more than a threshold amount of weight) than the normalized weight for the related bench press with handles. In response to detecting the discrepancy in weights suggested or applied for the two related exercise movements, recalibration is performed for one or both of the movements (because it is likely that the prescribed weight for at least one of the moves is incorrect, and thus confidence that the correct weight is being provided is lower).

The information used to determine whether to perform calibration may be provided in a variety of ways, such as explicit user input and/or derived from information maintained about the user by the exercise machine and/or the backend. For example, the triggers for determining whether to prescribe calibration may be provided by the user via a user interface, where the exercise machine determines whether to prescribe the calibration set based on the user input. The user may also explicitly request that a calibration set be prescribed. For example, the user may indicate via a user input, their change in injury status. The user may also indicate a last time that they exercised. The exercise machine may also automatically detect changes in user ability or automatically determine an amount of inactivity, and automatically determine that recalibration should be performed.

Parameter Selection

In some embodiments, the progressive strength calibration engine takes as input the following example parameters:

- Low weight: In some embodiments, the low weight is the weight that a user starts at for a calibration set. In some embodiments, the low weight is an estimate of what the user is able to easily do.
- High weight: In some embodiments, the high weight estimates a very challenging weight for the user. In some embodiments, a high weight determines how quickly the weight increases during progressive strength calibration.
- Reference speed: In some embodiments, the reference speed (also referred to herein as the "target" speed) estimates a speed slightly below what the user would normally do during the concentric phase of a rep. In some embodiments, the reference speed is tunable. In some embodiments, different movements/exercises have different reference speeds. In some embodiments, the reference speed is personalized for a given user. For example, for some moves, people move faster or slower. If the person is determined to be of a type that moves fast, then the reference speed is made a higher value.

The various parameters used to determine the progressive strength calibration are dynamically adjustable. For example, the parameters are adjustable by move and/or user.

In the example of FIG. 2, the calibration parameters are determined by calibration parameter determination engine 224 of backend 206. In other embodiments, the calibration parameters are determined by exercise processing engine 208 (or a combination of both backend 206 and client exercise machine 202).

In some embodiments, the parameters are determined based on whether there is historical information about the user (e.g., stored in user data store 226). For example, if there is historical information about the user (e.g., the user has performed the move for which progressive strength calibration is being performed), then that information is used to determine personalized low/high weights and personalized reference speed. For example, if there is a large amount of information known about the user (e.g., there is historical information for the user from having performed other sets), then the range of weights (difference between high weight and low weight) can be narrowed.

As one example, the exercise machine determines, with 95% confidence that the user's strength is between two weights. Those two weights are set as the low and high weight parameters for the progressive strength calibration mode. Further details regarding parameter determination are described below.

In comparison to a new user (for which, as will be described in further detail below, a wider range of weights is evaluated), in this example, the strength of the user may be assessed much more quickly, such as within one or two repetitions (as the range of weights to assess is narrower). In this way, a smaller proportion of the set is used to determine an estimate of the user's strength, with a larger proportion of the set being at an appropriate weight for the user, allowing them to have a more effective workout (whereas if nothing is known about the user, the first several repetitions may be too easy for the user, but not enough is known about the user to provide a more targeted starting point).

If there is not historical information about the user, demographic information may be used. For example, the user may provide, via a UI (e.g., during onboarding), information about themselves. This demographic information may be compared with global information for numerous other users to determine the low/high weights and reference speed.

In some cases, there may not be any information (demographic or historical information) about the user with which to determine the calibration parameters. This may be because the user is using the machine in the context of a demo (e.g., at a store, trying out the exercise machine, where the user does not provide any information about themselves). In this case, a set of default calibration parameters is used. As one example, suppose that the user is a brand new user, and the exercise machine does not have any information about the new user. In this example, the low weight is set very low, and the high weight is set very high. This results in a large range of weights. The progressive calibration mode will accelerate through the entire range, eventually settling on a weight. Further details regarding determining default calibration parameters are described below.

In some embodiments, the progressive strength calibration parameters described above may be selected or adjusted based on the type of condition that triggered prescription of the progressive calibration mode. In some embodiments, the parameters are adjusted based on the combination of both the type of trigger, as well as historical and/or demographic information about the user.

For example, suppose that the user is performing a bicep curl, and has previously performed them before. The exercise machine determines, based on the user's past performance, a certain low/high weight and reference speed.

The exercise machine further determines, based on a record of when the user last used the exercise machine, that it has been several months since they used the machine. Based on the amount of time away from the machine, the exercise machine further adjusts the low/high weights (e.g., by reducing the low weight by a percentage that is determined based on the amount of time away). In this way, the exercise machine is able to determine an estimate of the user's variation over time. Further, the various triggers may indicate lower confidence in the use of historical information to determine calibration parameters, and thus trigger recalibration by the exercise machine.

Thus, based on a variety of factors, the exercise machine determines the calibration parameters for the user (e.g., the personalized calibration parameters to be used in the strength calibration algorithm). In this way, the user will be closer to the appropriate weight from the beginning of the calibration set, and the increments by which the weight is progressively increased are smaller. This improves the workout efficacy of the calibration set (rather than, for example, starting with a very low weight, where the first several repetitions are too easy for the user).

In another embodiment, the weight begins at a value that is the best estimate of a challenging weight rather than the low weight. The weight then dynamically, and in real-time, increases and decreases within an estimated range of appropriate weights as a function of the user's performance during the set. Since the weight starts at a weight that is likely very close to the appropriate weight, it can be used regularly and more broadly rather than only as a calibration. For example, if the user last performed a movement at 50 pounds (lbs) but has not worked out in a way that is tracked in a month, then the most likely estimate (starting weight) may be 45 pounds, the low weight 40 pounds, and the high weight 55 pounds, as determined using the techniques described herein and population-level data about people's strength changes over time. If the user performs well (e.g., because they worked out without tracking during the month), then the weight would increase from 45 pounds until their performance degrades and the weight is determined to be sufficiently challenging.

Further details regarding progressive strength calibration parameter selection are described below.

Swapping in a Calibration Set

In some embodiments, the calibration set is integrated into the programming of a workout routine. For example, rather than being a standalone calibration mode, the calibration set for a movement replaces a first set (or any other set) of that movement in a workout routine. In this way, the calibration set naturally and seamlessly fits into a workout routine that a user is performing.

Via the progressive strength calibration control described below, not only is an accurate estimate of the user's strength determined, but it is determined in a manner that still allows the user to have an effective workout. In some embodiments, the replacement is performed during onboarding, when the user is performing a new, first workout. Various sets for different movements in the routine may be swapped out for calibration mode sets.

In some embodiments, swapping in of a calibration set is performed when building a workout timeline. For example, when the timeline is being received or obtained (e.g., from the backend), calibration prescription engine 220 of workout engine 218 determines for which movements calibration should be performed. For certain sets of movements, the progressive calibration mode is turned on, which causes the weight for that set to be adjusted, and corresponding measurements taken, according to the progressive strength calibration algorithm described herein.

As described above, in some embodiments, the parameters are determined by the backend (e.g., personalized by the backend based on the user's history, which is stored in the backend server), and then provided to the application on the exercise machine as part of the timeline.

In some embodiments, after it has been decided that recalibration should be prescribed, and the calibration parameters are selected or otherwise determined for the calibration set, the calibration parameters are sent from exercise processing engine 208 to progressive calibration engine 222 (e.g., implemented in firmware) at the start of the calibration set, where the firmware is configured to control the resistance provided by the motor according to a function that takes the calibration parameters as input. Further details regarding the strength calibration algorithm implemented in the firmware will be described below.

In other embodiments, the recalibration may also be used as a standalone test. For example, on a periodic basis (e.g., every two months), the users accept a challenge to determine their strength. A calibration set is prescribed to obtain an estimate of how the user is currently doing. The tests may be prescribed over a period of time, with the results evaluated to determine an improvement in strength of the user.

Execution of a Progressive Strength Calibration Algorithm

As will be described in further detail below, performing progressive strength calibration includes increasing weight during the concentric phases of repetitions as a ramp, to cover the range of weights defined by the low and high weight parameters. For example, while the user is in a concentric phase of a repetition, the weight or resistance applied is increasing as the range of motion increases. Further, in some embodiments, the rate at which the weight increases also increases as the set continues—that is, the weight is accelerating.

In the progressive strength calibration, weight is added progressively. This includes adjusting the resistance provided in increments or steps, where the weight is adjusted over time. In some embodiments, this includes defining an amount of weight to add per unit step or stage. This includes defining an amount of weight to add or reduce per unit time (e.g., rate of weight change).

For example, existing isokinetic techniques are fast controllers that quickly adjust weights to force a user to move at a certain fixed speed and be kept there. In contrast, in the progressive calibration algorithm described herein, even if the user goes above the reference speed, it may take several repetitions before the weight is adjusted to a point that the user's speed is reduced back down to the reference speed (rather than, for example, milliseconds, as in existing calibration techniques).

As described above, in some embodiments, the progressive strength calibration engine is configured to determine a rate of weight change (during a concentric phase of a repetition). The rate of weight change is determined based on a number of components, and will change over the course of the calibration set.

For example, the progressive strength calibration determines the appropriate challenging weight for a user over the course of a calibration set. The progressive strength calibration gradually and continuously increases the weight until the user's speed reduces, and then hones in on the appropriate weight with smaller increases and decreases.

The progressive strength calibration provides various benefits to the user experience, such as that the progressive strength calibration:

- works well if the user is not warmed up by gradually increasing the weight
- does not push the user to failure, and reduces the weight when the user begins to struggle
- feels mostly like normal weight
- is easy to do correctly, improving the resulting predictions of weights for the user for this and other movements.

In some embodiments, the weight changes during concentric phase (where in some embodiments the weight in the eccentric phase is constant) at a rate (e.g., pounds per millisecond, or lb/ms) that varies depending on the user's motion. The rate may be expressed in other units in various embodiments. In some embodiments, the rate has two components that, in the below example, are summed.

1. Constant, a fixed amount of weight change per second depending on whether or not the speed is above or below the target speed ("constant_1" in the below example progressive strength calibration code).
2. Proportional to the difference between the measured and target speed times a scaling factor ("constant_2" in the below example progressive strength calibration code).

In some embodiments, the rate of weight change also increases as more reps are completed, such that the total weight or resistance appears to "accelerate" upwards under normal usage. The following is a simplified example of code for determining the rate of weight change in the progressive strength calibration mode described herein.

```
Rep_scaling=1+rep_count*0.6//scalar

Constant_1=1e-7*(high_weight−low weight)//lb/ms

Constant_2=7.5e-5*(high_weight−low weight)//(lb/
    ms)/(inch/sec)

If (speed>target_speed): weight_per ms=rep_scaling*
    (Constant_1+(speed−target_speed)*Constant_2)

Else: weight_per ms=−1*rep_scaling*Constant_1
```

As described above, there are at least three input parameters that are provided for each calibration set (or set that has progressive calibration mode prescribed).

As described above, the input parameters to the progressive strength calibration algorithm include:

1. Low_weight (per trainer arm), which in some embodiments is an estimate of what the user can easily do (this may also be the starting weight for unknown users).
2. High_weight (per trainer arm), which in some embodiments estimates a very challenging weight for the user.
3. Target_speed (per trainer arm), which in some embodiments is a reference speed that estimates a speed that is slightly below what the user would typically do during concentric phase.

As shown above, the components are weighted by factors, where at least some of the factors are based on a proportion of the difference between the high and low weights. For example, if the range of weights to cover or assess is a narrow band, then the weight needs to increase quickly (as compared to a set that has a larger range).

As shown in the example above, in contrast to existing isokinetic calibration techniques that are purely speed-based, the progressive strength techniques described include a component in which the weight applied is independent of the speed, and a distribution of weights to be assessed is defined and progressively evaluated throughout the course of the calibration set.

Scaling by Repetition Number

As shown in the above example, one component of the progressive strength algorithm is the number of repetitions. As more repetitions are performed (indicating the user's progress through the set), the rate of weight change increases. In some embodiments, the range of weights to be assessed (difference between high and low weight parameters) is distributed across the number of repetitions in the calibration set (and more specifically, across the aggregate concentric phases of the repetitions, in some embodiments).

Scaling by the repetition number, as shown in the example above, facilitates covering a wide range or distribution of weights where a user may end up (where their challenging weight for the movement is) without having to increase the weight too quickly.

This scaling is analogous to compound interest, but in this case, the weight increases according to an exponential function, where there is a percentage increase from one repetition to the next. This is in contrast to using, for example, a linear function where the weight is increased proportionally every repetition.

For example, suppose that the user's correct weight for performing an exercise is 12 pounds, and strength calibration is performed to identify that weight of 12 pounds. If the weight were increased proportionally for every repetition, without variation based on the repetition number, then given a 10 rep set, with low and high weights of 10 pounds and 50 pounds, respectively, with a 40 pound difference, the weight would be increased by 4 pounds every repetition. Thus, by the second repetition, the weight is increased to 14 pounds. In this case, the user would have only performed half a repetition before resistance provided exceeded their abilities.

Thus, using the techniques described herein, the weight is gradually ramped up so that the user's appropriate weight is identified after several reps, and for a particularly strong user, their maximum weight may be determined later on in the set (e.g., at repetitions 9 or 10).

Using the techniques described herein, the level of accuracy is, for example, percentage-based for every user, and smaller differences in weight at the lower end of the range may be identified. In this way, equal accuracy is provided for various kinds of users (e.g., both strong and weak users). For example, the weight is increased 10% for a user from repetition to repetition, but at a higher weight later on, versus a lower weight earlier on in the set.

Reference Speed

As also shown in the above example, another component of the progressive strength calibration algorithm is speed-based. For example, as shown in the above code, the rate of weight change depends on whether the user's speed is above or below the target/reference speed (as shown, for example, in the If/Else statement in the above code). Further, as shown in the above example code, in some embodiments, the rate of weight change is determined based on the difference between the user's speed (e.g., as measured based on change in cable position over time) and the reference speed.

Above Reference Speed

In some embodiments, the more above the reference speed the user is, the greater the amount of weight added. In some embodiments, while how much higher the user's speed is above the reference speed determines at least one component of the extra weight that is added during a repetition, the majority of the additional weight is not a component of the amount of speed difference, but whether the user's speed was above or below the reference speed. This accounts for the variation in the speed at which different users perform exercise movements. For example, different people have different habits, where some people prefer to do repetitions slowly, even if the weight is light, while others may prefer to do their repetitions quickly.

Below Reference Speed

In some embodiments, if the user is below the reference speed, the amount of weight is reduced. This is based, for example, on a determination that the user's maximum strength is close to being reached (which is why the user's speed is below the reference speed). In this way, the weight is not increased as much. If the user then further continues to do repetitions and they go above the reference speed, the weight will increase, but at a slower rate. That is, the weight had been accelerating (in the increasing direction), was then stopped, and is then allowed to increase gradually if the user continues to do well.

In some embodiments, after the first time the weight is reduced because the user went below the reference speed, the rate of weight change also decreases (e.g., becomes a smaller positive value). In some embodiments, the speed reduction is in two parts. For example, for a first portion of the reduction, if the user's speed is below the reference speed, then the resistance or weight is reduced by a fixed amount over a next time period (e.g., for the next timestep). For the second portion of the reduction, the resistance is reduced further based on the amount by which the user's speed is below the reference speed.

In some embodiments, as the weight is being reduced, how much the weight has been reduced by is tracked. To filter out false positives, this amount of weight is assessed (e.g., where the weight may be reduced because the user paused for a brief period, and then continued). For example, the rate which the weight increases is slowed if the user has had their weight reduced significantly.

In some embodiments, if the user slows down and speeds up again, the weight is not increased as quickly as previously, as it is determined that the user's maximum weight is being approached, and they were not able to lift the weight at the reference speed.

In other embodiments, reducing the weight includes reducing the high weight parameter. This changes the range of weights that are assessed over the calibration set, and which also causes the rate of weight change to be varied.

Sensor Measurements for Speed

As described above, the progressive calibration is based on the measurement of the user's speed, which as one example is determined from sensor measurements on the change in cable position.

In some embodiments, the measurements of cable speed that are used for the progressive calibration are measurements taken during the concentric phase of the repetition, where the progressive weight changes are applied only in the concentric phase. In some embodiments, during the eccentric phase, the weight is kept constant at the weight that the previous concentric phase ended at. That is, the progressive strength algorithm described above is not applied during the eccentric phase. Whatever the last weight in the previous concentric phase was is held constant until the next concentric phase starts.

In some embodiments, the progressive strength calibration and motor control is performed in real time. For example, during the concentric phase, cable speed measurements are taken periodically (e.g., at 50 Hz, or every 20 milliseconds), and at every time step, the weight is progressively adjusted.

If, during the concentric phase, the user is above the reference speed, then additional weight is added. As described above, another component of the progressive strength calibration is the amount that the user is above the reference speed for the previous timestamp (e.g., in an average manner), which, as one example, is multiplied by a gain factor to further determine how much more additional weight to add. Thus, the amount of weight or resistance to provide is continuously computed through the concentric phases of the repetition in the calibration mode set.

In some embodiments, the exercise machine determines that the first concentric phase is occurring/has occurred if the user's speed is above a threshold speed.

While in the above examples, the weight was progressively adjusted during the concentric phases of the repetitions in the calibration mode set to assess the user's strength, the calibration techniques described herein may be variously adapted to estimate the strength of a user by progressively adjusting the weight during other phases of a rep, such as during the eccentric phase.

Progressive Strength Calibration Output

The progressive calibration engine is configured to provide various types of output based on the (re)calibration using the progressive strength calibration mode described herein. The calibration mode set includes a number of repetitions. For example, the set may include 10 repetitions. Other numbers of repetitions may be used in a calibration set. The calibration set ends after the predefined number of repetitions is completed.

In this example, an estimate of the user's strength was determined by progressively increasing the weight over a number of repetitions, and observing the user's speed relative to the reference speed. As one example, suppose that the calibration set includes 10 repetitions. Here, the estimate of the strength is the user's 10-rep max or other N-rep max equivalent value (that is, not a one-rep max, but a maximum for performing a different number of repetitions). That is, an N-rep maximum is determined that is a challenging or maximum amount of weight that a user can counter for the defined number of repetitions of the exercise movement (e.g., the heaviest weight the user can act against for N-consecutive repetitions).

In some embodiments, the N-rep max is determined as the final weight applied to the last repetition during the calibration set. In some embodiments, the N-rep maximum estimated as a result of the calibration set is converted to a one-rep max, where the one-rep max is a fraction of the N-rep max estimate.

In some embodiments, the conversion is performed according to a mapping. One example of a mapping is one that maps a number of repetitions to a percentage of the one-rep maximum. The mapping may be a linear function, an exponential function, etc. Different mappings may be used for different types of moves and people.

The following are further examples of outputs and actions that are taken based on the progressive strength calibration described herein.

For example, the output of the calibration mode set (e.g., the N-rep strength estimate for the user) is used in various embodiments. For example, the strength estimate is used to determine suggested weights for future sets/repetitions of the given exercise or movement for which strength calibration was performed.

As another example, various measurements taken during the performance of the calibration set are stored. For example, the N-rep max weight (or final weight or resistance applied or assessed during the calibration set) is stored. This N-rep max is the estimate for the most challenging weight the user can perform for a set including N reps of the movement.

The max weight per repetition is stored for every repetition performed during the calibration set. In some embodiments, the set of measurements is associated with a flag indicating that the set to which these measurements belong is a calibration set.

In some embodiments, a data structure (e.g., table) is generated for storage of data pertaining to calibration sets. For example, for each calibration set, in addition to the aforementioned measurements determined during a given calibration set, the calibration parameters (e.g., the low/high weights and reference speed) that were selected for the calibration set are also stored to the record for the given calibration set.

The results of the calibration may also be displayed or otherwise presented to the user. For example, the one-rep max (e.g., converted from the N-rep max) may be displayed to the user.

The progressive strength calibration mode described herein provides various benefits, one of which is that by gradually increasing the weight across the repetitions in the set, the user experience is improved, and is more akin to performing a regular set.

Further, in contrast to existing isokinetic calibration techniques, the progressive strength calibration described herein does not require force-velocity curves. This provides a simplified and more accurate calibration, where in the progressive calibration mode, samples are taken and feedback is applied in order to arrive at an estimate of the user's strength. Further, the progressive strength calibration techniques described herein provide increased safety, in that a metric such as one-rep max is estimated without the user having been made to perform an actual repetition at the one rep max weight. Rather, the user performs up to their N-rep max (where N is greater than one, and where N is selected, for example, to match the number of repetitions that would be performed in a regular, non-calibration mode set in a workout routine).

Further, the progressive strength calibration techniques described herein are usable to estimate a suggested weight or ideal weight for a set of exercises with multiple repetitions, which is useful, as users typically do not perform a set where all the repetitions are at their one-rep max. By using the techniques described herein, an appropriate weight for a set with any number of repetitions may be determined.

For example, if the calibration set included 10 repetitions, then the progressive calibration is used to determine a 10-rep max (or some other equivalent), which is a desired weight to suggest to a user when performing sets with 10 repetitions of the exercise.

As described above, the 10-rep max may be converted to a one-rep max (which provides a standard measure, and may be stored as the state for the user's suggested weight). If the user then performs a set of the exercise with 15 reps, the one-rep max is converted to a 15 rep max (e.g., by using the mappings described above). That is, the one-rep max determined from the calibration may be adjusted for sets with varying numbers of reps.

In the above examples, the amount of resistance to provide throughout strength calibration is determined automatically. In some embodiments, the user is able to manually control the progressive calibration mode. For example, the user manually lowers or raises the weight (e.g., via buttons, vocal commands, or other types of user input) until it is at a suitable point for the user. In some embodiments, rather than the exercise machine determining the appropriate weight for the user, the user may indicate (e.g., through user input such as button presses or vocally) whether they have reached an appropriate weight. For example, the weight is continually and gradually increased while the user provides explicit feedback, while lifting, via button presses, gestures, or speaking. For example, the user may press one button to increase the weight and another to decrease it until they feel the weight is appropriate and challenging, or the weight may increase until the user says the word "stop".

As shown in the examples and embodiments described above, using the progressive calibration described herein, an appropriate or ideal weight or resistance to provide for a given exercise is determined by progressively increasing the weight and sampling the speed, where the speed is used as feedback to further settle on or arrive at the ideal weight for the user.

Strength Calibration for Bicep Curl Example

The following is an example of performing progressive calibration for a bicep curl. In this example, suppose that strength calibration is to be performed on a new user, for the bicep curl move.

In this example, suppose that the new user has created a new account, and has provided some demographic information about themselves as part of creating the new account. The user would like to perform a workout routine that includes sets of bicep curls (among other movements). As described above, the exercise machine, based on a variety of indicators (e.g., that they are a new user), determines that for a given exercise, rather than having the user perform the exercise in a normal mode, to switch to a progressive calibration mode for the first set of bicep curls in the workout routine. In this way, rather than having a user perform a set of standalone calibrations for a variety of exercises, the user is calibrated in the course of performing a workout, by swapping in a calibration mode set.

In this example, the calibration mode is prescribed because the user is a new user. In some embodiments, the user is notified that they are being switched to a calibration mode version of a set. In some embodiments, the user has the option to indicate that they do not wish to perform a calibration mode version of the exercise.

In this example, the demographic information provided by the user is used to determine the parameters for the progressive strength calibration. For example, the demographic information known about the user may be used to select a narrower range of the low and high weight parameters (as compared to, for example, default calibration parameters that would be used if there were no information about the user at all).

In this example, the low weight is set at 10 pounds, as this is determined to be a weight the majority of individuals in the user's demographic should be able to lift. In this example, the high weight is set at 50 pounds. In this example, the reference speed for the bicep curl is set at 20 inches per second, where, for example, the reference speed is set at a lower end of what a person matching the user's demographic profile would typically perform the bicep curl at.

The user then begins performing repetitions in the calibration set. In this example, the first repetition begins at the low weight parameter of 10 pounds. The second repetition is at a higher weight. The amount of weight increases from repetition to repetition in order to cover the range of weights defined by the low and high weights (which are the end points of the range). The amount of weight increases according to a function (e.g., exponential, quadratic, etc.) of the parameters, such as the example progressive strength calibration algorithm described above.

As described above, the rate of weight change increases as the user progresses through the set. That is, the changes in weight from repetition to repetition increase the more repetitions that are performed. For example, if the person performs well in their first repetition, and is above the reference speed, then the weight is increased from 10 pounds to 12-15 pounds for the next repetition, and if that repetition is performed well, then the subsequent repetition may be at 16 or 18 pounds. The amount of weight increase will continue to grow (e.g., the rate of weight change increases, so that the increments in weight change are larger at each step as the calibration progresses), and after several more repetitions, the weight may be set at 30 pounds, before slowing down (e.g., as the user gets closer and closer to the reference speed). That is, the weight adjustment increments become larger and larger as the user progresses through the calibration mode set. At the conclusion of the calibration set, the final weight is determined, for example, as the 10-rep max for the user when performing bicep curls. Various output and actions may be taken based on the progressive calibration, as described above.

Figure 3:
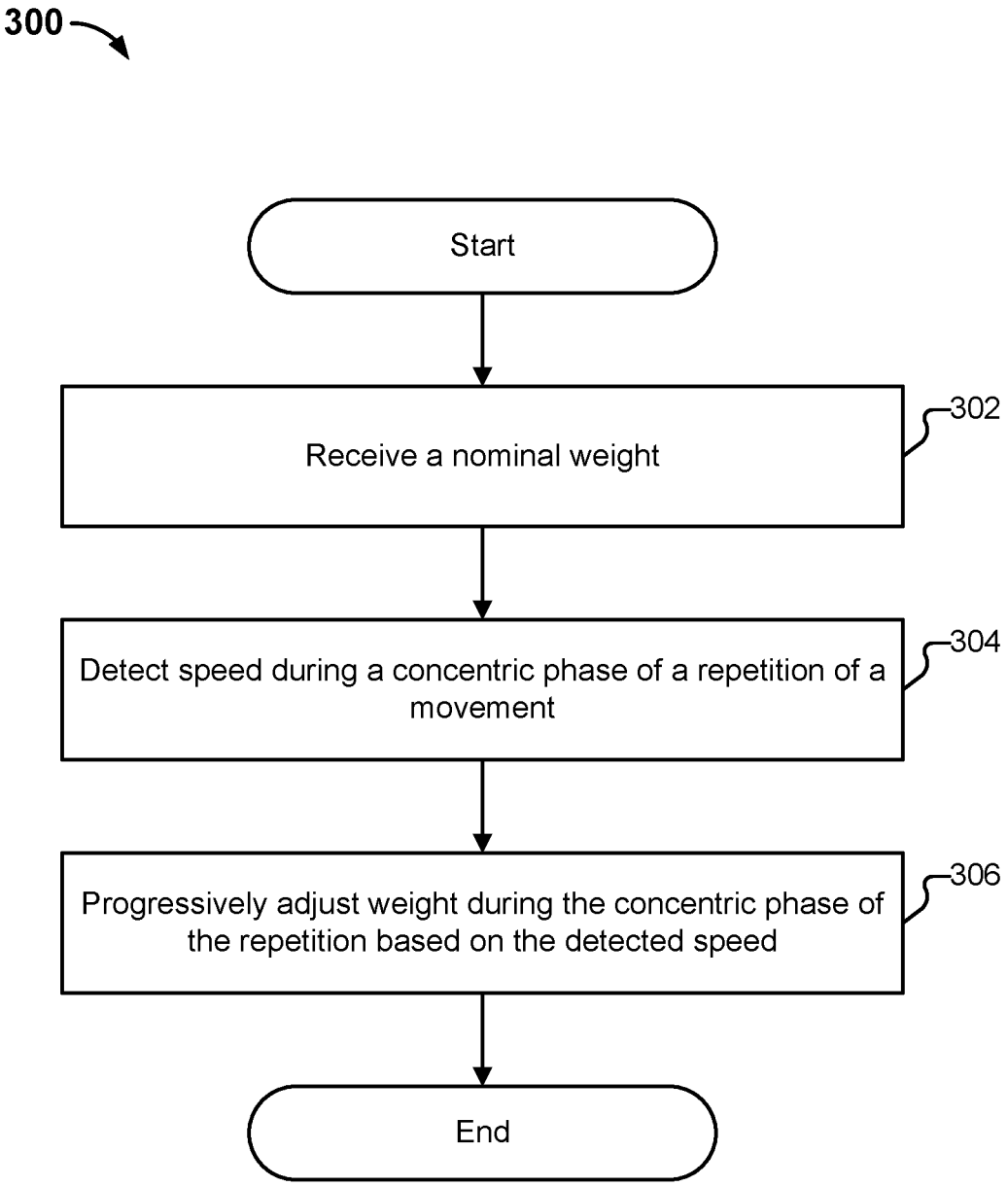
FIG. 3 is a flow diagram illustrating an embodiment of a process for controlling weight during a movement.
Figure 4:
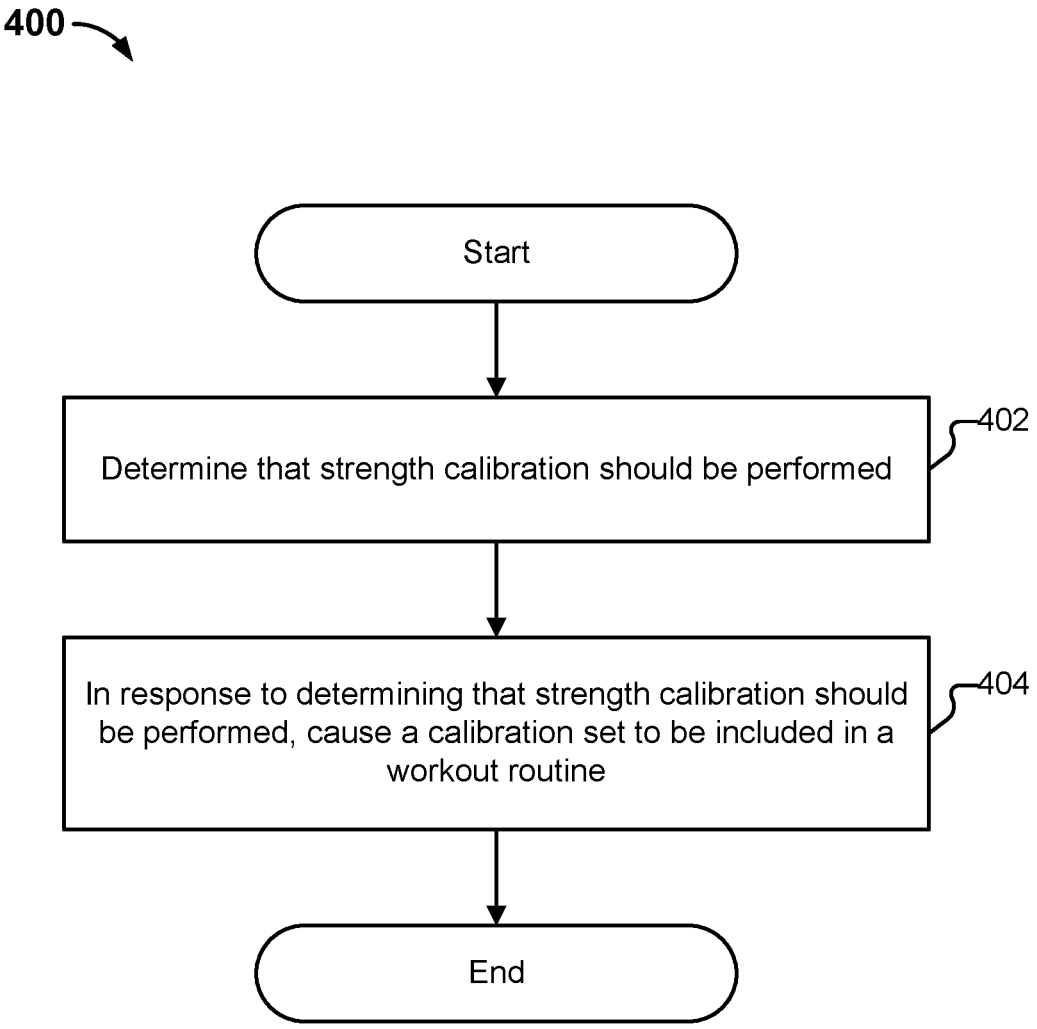
FIG. 4 is a flow diagram illustrating an embodiment of a process for prescribing calibration.

FIG. 3 is a flow diagram illustrating an embodiment of a process for controlling weight during a movement. In some embodiments, process 300 is executed by progressive strength calibration engine 222. The process begins at 302 when a nominal weight is selected. For example, the nominal weight is the low weight parameter described above. The nominal weight may be selected based on historical information associated with a user performing the movement, demographic information pertaining to the user, etc. The nominal weight is included in a set of calibration parameters that also include, for example, the high weight and reference speed parameters described above. The progressive calibration mode may be triggered based on various conditions and triggers, such as a period of inactivity of the user, an injury status of the user, etc. As one example, process 400 of FIG. 4 is used to determine whether calibration should be performed. If so, then process 300 is executed.

If little information is known about the user, then, in some embodiments, the weight or resistance applied is set at a low value (e.g., the nominal or low weight calibration parameter is set low). During calibration, the weight will be increased at a higher rate of weight change to higher weights if the user moves quickly. In this way, an appropriate and challenging weight is determined for a user after several reps for any user, whether very strong or not strong.

If more information is known about the user, such as an estimated level of strength, or if there is historical information pertaining to the user (e.g., the user has previously completed a set with the progressive strength calibration mode enabled or prescribed), then the starting weight (e.g., nominal weight) is dynamically selected to be closer to a, for example, conservative/low estimation of the user's strength. The rate of weight increase is also slower so that the weight does not far exceed an appropriate and challenging weight for the user.

As described above, these example parameters include low weight, high weight, and target speed:

1. The low weight is an estimate of what the user may easily do.
2. The high weight estimates a very challenging weight for the user.
3. The target speed estimates a speed slightly below what the user would normally do in concentric phase.

At 304, speed is detected during a concentric phase of a repetition of the movement. For example, the speed of a cable that the user is pulling on is measured periodically throughout the concentric phase.

At 306, during the concentric phase of the movement, the weight is progressively adjusted based on the detected speed. The weight is further adjusted based on the nominal weight. In some embodiments, the weight is adjusted to achieve a desired speed profile for the movement. As one example, the speed profile is to have one speed throughout performance of the movement, or vary speed during various phases of the movement. In some embodiments, the weight is progressively adjusted by controlling a resistance mechanism (e.g., motor) to provide the determined weight or resistance.

In some embodiments, the speed of the user is automatically detected. The user's speed is used to determine the rate of weight increase or decrease dynamically throughout (the concentric phases of) each rep.

As shown in the above example code for determining a rate of weight change during the progressive calibration mode, in some embodiments:

The rate of weight change (lb/sec) has two components that are summed:

1. Proportional to the difference between the measured and target speed.
2. Constant, a fixed value for the measured speed being >(greater than) or <(less than) target/reference speed.

The components are added to find the rate of weight change.

Also, the parameters described above may increase or decrease as more reps are completed and as the weight changes.

As shown in the above example, the weight is adjusted throughout the concentric phases of the reps of the calibration set. This is to evaluate a user's effort or performance at various different weight points in a range of weight points. The user's effort or performance is measured based on their speed when countering the resistance at a given weight. The rate at which the weight is changed (e.g., in order to cover a range of weights to be evaluated, where the range is defined by the low and high weight parameters) is based on a variety of factors, such as the low/high weight, the number of reps being performed, etc. The rate of weight change causes the weight to be adjusted progressively by determining, for each successive time step, the incremental change in weight that is provided as resistance to the user (where in some embodiments, the weight or resistance provided by the load element is adjusted on a periodic basis by sending instructions to, for example, a motor controller to change the amount of torque/weight).

At each weight, the speed of the user is sampled at the given weight. The speed of the user, relative to a target speed, indicates how much the user is struggling and whether the weight is an appropriate weight for the user (e.g., a weight that challenges the user, but does not cause them to fail). For example, the more the measured speed is below the target speed, the greater the indication that the user is struggling at a given weight. The more the measured speed s above the target speed, the greater the indication that the given weight is too easy for the user (and is not challenging enough for the user, and would not aid in strength development).

The sampled speed at a given weight is used as feedback to the progressive strength calibration algorithm to determine the next incremental step change in weight (e.g., by determining a new rate of weight change). For example, the algorithm is re-executed each time a sensor measurement is received (e.g., at 50 Hz). As shown in the above example, in addition to a constant, there is also an adjustment factor that is based on the difference between the measured speed and the target speed.

In the above example algorithm, rather than forcing the user to immediately move at a specific speed (e.g., by immediately lowering the weight when the user is below the target speed), the calibration algorithm allows the weight that is applied to continue to increase even when the user is below the reference speed (although the rate of weight change may be lower relative to the previous timestep).

In some embodiments, the resistance applied during subsequent sets of the movement (non-calibration mode sets) is determined based on the results of the progressive strength calibration described herein.

As described above, the weight is increased during the concentric phase when the user moves quickly (e.g., above the reference speed), and the weight is decreased when the user moves slowly (e.g., below the reference speed). As the set goes on and the more reps are done (e.g., as the number of reps completed increases), the weight changes are more gradual as the user approaches the appropriate weight for them (e.g., the rate of weight change becomes smaller and slows, and the appropriate weight is settled on).

FIG. 4 is a flow diagram illustrating an embodiment of a process for prescribing calibration. In some embodiments, process 400 is executed by calibration prescription engine 220. The process begins at 402 when it is determined that strength calibration should be performed for a movement to be performed by a user. The determination may be based on a variety of factors, such as a period of inactivity, injury status, etc.

At 404, in response to determining that strength calibration should be performed, a calibration set is caused to be included in a workout routine. As one example, causing the calibration set to be included in the workout routine includes replacing or swapping an existing set in a workout with the calibration set.

In some embodiments, including a calibration set causes the resistance provided to a user during performance of the calibration set to be determined according to a calibration algorithm, such as the progressive strength calibration algorithm described herein. For example, process 300 is executed to implement progressive strength calibration for the calibration set.

As described above, the progressive strength calibration techniques described herein continuously and slowly adjust the weight or resistance over several reps. The gradual increase in weight has several benefits. For example, the gradual adjustment serves as a small built-in warmup, thereby reducing injury risk versus performing a maximum effort rep first. Using the progressive strength calibration techniques described herein, users with less experience lifting have several reps to become familiar with the movement before the weight is challenging, reducing the intimidation of strength training and also reducing the injury risk due to poor form. Further, using the progressive strength calibration techniques described herein, users do not perform a maximum strength rep. Instead, the one-rep max (1RM) is accurately estimated based on reps at higher speeds and lower weights. Again, the result is reduced injury risk and less intimidation to users new to strength training.

Additional Details and Embodiments Regarding Selection of Progressive Strength Calibration Parameters The following are further details regarding selection of progressive strength calibration parameters.

Default Parameters by Movement

The calibration parameters described above, such as low weight, high weight, and reference/target speed provide a form of estimation of the user's strength. In the case where there is no prior knowledge about the user, such as in an unattended retail situation, default calibration parameters are selected for each movement.

In some embodiments, each move has default values for the below example three parameters, with the following example specifications:

1. Low weight—For example, a weight that nearly every healthy person is able to lift for the given movement
2. High weight—For example, a weight that is challenging for a very strong, experienced person, but not a professional.
3. Target speed—For example, a speed on the low end of normal for the given move. If the user is going below this speed, they are very likely struggling, but have not yet failed.

In some embodiments, the low and high weight values are used to determine strength scores and suggest weights for movements.

The following is an example of determining default values for the above parameters. As one example, the $5^{th}$ percentile of sets' weight is selected as the default low weight, and the $90^{th}$ percentile as the default high weight. As one example, the $10^{th}$ percentile of reps' maximum concentric speed is selected as the default target speed. In some embodiments, default values are based on an evaluation (e.g., statistical evaluation) of historical global data collected from multiple users/exercise machines used by various users.

The values from historical data (e.g., historical data pertaining to users of exercise machines) may not match the example specifications above, even with large datasets. In some embodiments, for the reasons listed below, review of the values by fitness experts is performed to ensure that the selected default weights are appropriate for a wide range of users' strengths. One example class of reasons is that different groups of people perform moves at different frequencies.

For example, men and women have different workout habits, on average. On average, men are stronger than women.

For example, some moves are for beginners, while other moves are for advanced users, where advanced users tend to be stronger than beginners on average.

For example, some moves are included in a few popular programs or workouts that have a certain population of users whose strength may not match the general population's distribution of strength.

Other, less common, reasons may include:

A user performs the wrong move, which may occur more frequently in custom or free-lift workouts A user performs the move with incorrect form, and lifts a higher weight.

Adjusting Parameters after Feedback

In some embodiments, feedback is gathered or collected from users and used to improve parameter selection. This includes adjustment of the calibration movement parameters of low weight, high weight, and reference speed, as well as progressive strength calibration algorithm parameters, such as "constant_1" and "constant_2" described in the example code above used to determine a rate of weight change. For example, if a problematic trend exists across many moves, then this may be an indication that, for example, at least one of the constants should be adjusted. If a problem exists more with some movements than others, this may be an indication that one of the movement parameters should be adjusted (low weight, high weight, and target weight).

In some embodiments, parameters are discovered by scaling up and down the low and high weights and have users provide maximal effort, as if one was someone much weaker or stronger than oneself. The final weight on the last rep may be approximately the same.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A system, comprising:

a motor, wherein a cable is coupled between an actuator and the motor;

a processor configured to:

receive a set of parameters comprising a nominal weight, an upper weight, and a target speed;

determine, based at least in part on the nominal weight and the upper weight, a first rate of weight change, wherein the first rate of weight change comprises an amount of weight to add or reduce per unit time;

during a concentric phase of a repetition of a movement, control the motor to progressively adjust an amount of provided resistance according to the first rate of weight change;

detect a speed of the cable during the concentric phase of the repetition of the movement; and determine a second rate of weight change, wherein the second rate of weight change is different from the first rate of weight change, and wherein the second rate of weight change is determined based on:

a first value comprising a fixed rate of weight change that is based on whether the detected cable speed is above or below the target speed; and a second value that is proportional to a difference between the detected cable speed and the target speed; and a motor controller configured to control motor torque to progressively adjust the amount of provided resistance according to the second rate of weight change.

2. The system of claim 1, wherein the set of parameters is determined based on at least one of historical data associated with a user, and demographic data associated with the user.

3. The system of claim 1, wherein the detected speed is based at least in part on measuring a change in position of the cable over time.

4. The system of claim 1, wherein determining the first rate of weight change is based at least in part on a count of the repetition.

5. The system of claim 1, wherein the processor is further configured to determine an N-rep max comprising an estimated max weight for a set including N amount of repetitions, and wherein N is greater than one.

6. The system of claim 5, wherein the processor is further configured to convert the N-rep max to a one-rep max.

7. The system of claim 5, wherein the N-rep max is used to determine a suggested weight for a subsequent set of the movement.

8. The system of claim 1, wherein the repetition is included in a calibration set.

9. The system of claim 8, wherein the calibration set is included in a workout in response to an indication that a calibration should be performed.

10. The system of claim 9, wherein the calibration set is included in the workout based at least in part on a period of user inactivity.

11. The system of claim 9, wherein the calibration set is included in the workout based at least in part on an injury status of a user.

12. A method, comprising:

receiving a set of parameters comprising a nominal weight, an upper weight, and a target speed;

determining, based at least in part on the nominal weight and the upper weight, a first rate of weight change, wherein the first rate of weight change comprises an amount of weight to add or reduce per unit time;

during a concentric phase of a repetition of a movement, controlling a motor to progressively adjust an amount of provided resistance according to the first rate of weight change, wherein a cable is coupled between an actuator and the motor;

detecting a speed of the cable during the concentric phase of the repetition of the movement;

determining a second rate of weight change, wherein the second rate of weight change is different from the first rate of weight change, and wherein the second rate of weight change is determined based on:

a first value comprising a fixed rate of weight change that is based on whether the detected cable speed is above or below the target speed; and a second value that is proportional to a difference between the detected cable speed and the target speed; and controlling, via a motor controller, motor torque to progressively adjust the amount of provided resistance according to the second rate of weight change.

13. A computer program product embodied in a non-transitory computer readable medium and comprising computer instructions for:

receiving a set of parameters comprising a nominal weight, an upper weight, and a target speed;

determining, based at least in part on the nominal weight and the upper weight, a first rate of weight change, wherein the first rate of weight change comprises an amount of weight to add or reduce per unit time;

during a concentric phase of a repetition of a movement, controlling a motor to progressively adjust an amount of provided resistance according to the first rate of weight change, wherein a cable is coupled between an actuator and the motor;

detecting a speed of the cable during the concentric phase of the repetition of the movement;

determining a second rate of weight change, wherein the second rate of weight change is different from the first rate of weight change, and wherein the second rate of weight change is determined based on:

a first value comprising a fixed rate of weight change that is based on whether the detected cable speed is above or below the target speed; and a second value that is proportional to a difference between the detected cable speed and the target speed; and controlling, via a motor controller, motor torque to progressively adjust the amount of provided resistance according to the second rate of weight change.

* * * * *